United States Patent [19]

Biermann et al.

[11] 4,219,215

[45] Aug. 26, 1980

[54] CROSS-COUNTRY SKI BINDNG WITH RETAINING MEANS FOR A FORWARDLY EXTENDED BOOT SOLE

[75] Inventors: Peter Biermann, Warmbronn; Otto Ewald, Griesheim; Rudi Feucht, Weissach; Manfred Schmidt, Sindelfingen, all of Fed. Rep. of Germany

[73] Assignee: Vereinigte Baubeschlagfabriken Gretsch & Co. GmbH, Fed. Rep. of Germany

[21] Appl. No.: 836,362

[22] Filed: Sep. 26, 1977

[30] Foreign Application Priority Data

Sep. 25, 1976 [DE] Fed. Rep. of Germany ..... 2643223

[51] Int. Cl.[2] ..... A63C 9/10

[52] U.S. Cl. ..... 280/615

[58] Field of Search ..... 280/615, 614, 621, 626, 280/635; 24/68 SK, 69 SK, 70 SK, 68 T, 270

[56] References Cited

U.S. PATENT DOCUMENTS

| | | | |
|---|---|---|---|
| 2,559,020 | 7/1951 | Lehmkuhl | 280/615 |
| 3,532,352 | 10/1970 | Lusser | 280/626 |
| 3,625,532 | 12/1971 | Pauls | 280/626 |
| 4,004,823 | 1/1977 | Pyzel et al. | 280/615 |
| 4,082,312 | 4/1978 | Johnson | 280/636 |
| 4,129,319 | 12/1978 | Strohmeier | 280/615 |

FOREIGN PATENT DOCUMENTS

| | | | |
|---|---|---|---|
| 884766 | 7/1953 | Fed. Rep. of Germany | 280/615 |
| 2306721 | 11/1976 | France | 280/615 |
| 72184 | 7/1931 | Sweden | 280/615 |
| 103004 | 1/1924 | Switzerland | 280/615 |

*Primary Examiner*—David M. Mitchell

*Attorney, Agent, or Firm*—Craig & Antonelli

[57] ABSTRACT

A cross-country ski binding is provided which includes a boot sole holding member engageable with a boot sole extension to hold the same in position on a ski. Guide structure is provided at a bearing member fixed to the ski, which cooperates with a corresponding guide part of the holding member to guide the holding member to move in a forward longitudinal direction during its movement into the sole-holding position so that the boot sole is pulled forwardly into the binding as it is clamped into position.

48 Claims, 5 Drawing Figures

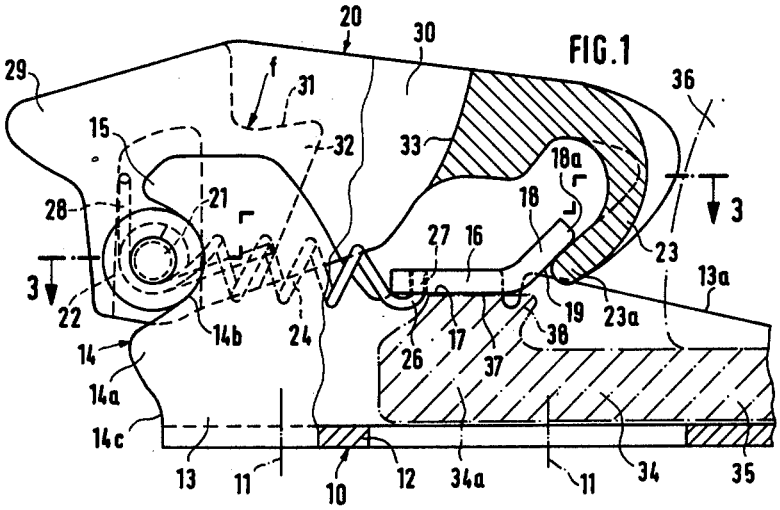
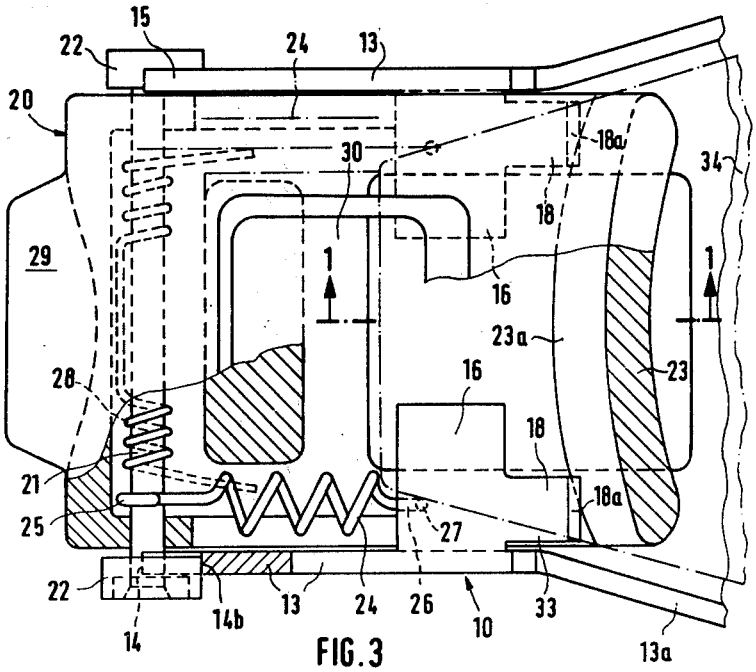
FIG.3

FIG. 2
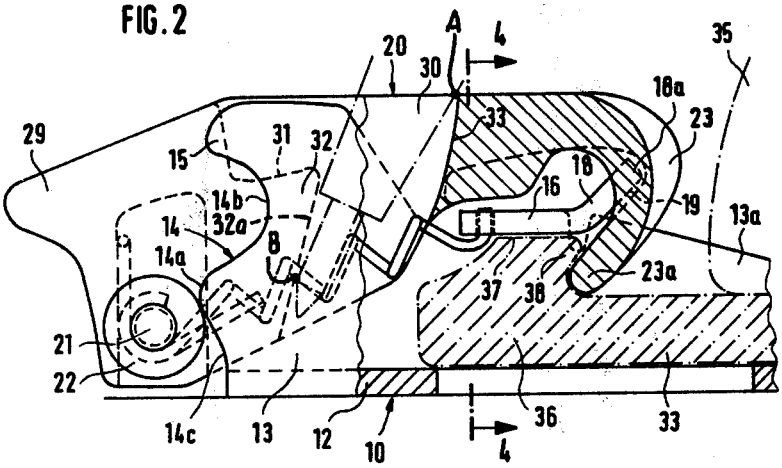
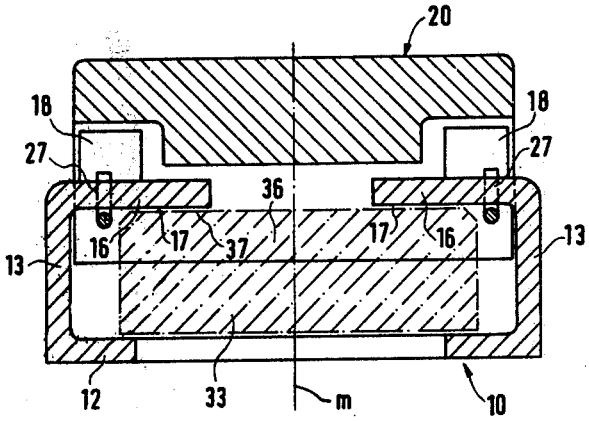
FIG. 4

CROSS-COUNTRY SKI BINDNG WITH RETAINING MEANS FOR A FORWARDLY EXTENDED BOOT SOLE

BACKGROUND AND SUMMARY OF THE INVENTION

The invention relates to a ski binding for cross-country skiing and the like comprising a retaining means for a forwardly extended sole of a ski boot with the use of a holding member holding, in the in-use condition, the extension of the boot sole. Such a binding makes it possible for the boot to be lifted off the ski about a forward transverse axis arranged in front of the toe region of the foot, which is a comfort feature for cross-country skiing, and this is accomplished without the mounting of special fittings, in the toe region of the sole. Furthermore, it is unnecessary to adapt the binding parts to the respective boot size, as is ordinarily the case in cross-country ski bindings for boots without a forward sole extension.

An important aspect of the invention is the solution of the problem of providing a satisfactory, especially firm seating of the sole of the ski boot on the ski with a reliable and simple operation with the use of relatively simple means. A further objective of the invention is the provision of a flawless locking of the binding even if snow is on the ski in the zone of the sole extension.

In particular, the invention is furthermore based on the problem of effecting, in a binding of the aforementioned type, on the one hand a vigorous forward pull of the frontal sole extension into the binding part and thus an especially solid retention of the sole extension and on the other hand a simple locking of the binding by pressure from above and optionally also a simple opening from above, if desired with the aid of the ski pole.

Accordingly, the invention contemplates that guide means are provided for the holding member, adjusting the holding member with respect to the ski from a lifted release position into a lowered in-use position displaced toward the front as compared to the release position so that, during the adjustment operation, the holding member extends behind a projection or a corresponding part at the boot sole extension for the positive entrainment of the boot sole into a forward, tightened position and/or for the positive locking of the boot sole in such a tightened position.

In a particularly preferred embodiment of the invention, the guide means guide the holding member with respect to the surface of the ski in a direction obliquely toward the front with respect to the surface and in an approximately translatory fashion. A resilient holding means is provided for retaining the holding member in an upper locked release position above the sole extension. Guide means are provided which simultaneously exhibit or define a lower locking sole holding position for the holding member. The holding member, after adjustment along the guide means, while overcoming a resistance of the resilient holding means, extends with the aid of a hook-shaped follower behind a counter projection on the sole extension, the pulling direction being oriented toward the front.

For a positive guidance of the holding member, the latter is positively guided in the zone of its front end as well as in the zone of its rear end between its two locking positions.

In a special embodiment of the invention, the guide means are constituted by curved guide tracks on which the holding member is guided from the lifted position into the lowered position.

The guide track or tracks are suitably disposed on the ski side, and the respective guide element on the side of the holding member. However, it is optionally also contemplated to provide a reverse arrangement.

Another special, advantageous embodiment of the invention consists in that the guide means are constituted by one or more guide rods, lever gears, or the like, corresponding from a kinematic viewpoint approximately to the aforementioned curved guide track. It is also contemplated, for example, to arrange a corresponding curved guide slot.

Furthermore, for the guidance of the descending holding member in the forward direction, a guide element, for example a sliding member or—in particularly preferred embodiments—a roller element is provided, which moves, if curved guide tracks are used, along a front guide or control curve track. For the rearward guidance, the hook-shaped follower proper forming part of the holding member can advantageously be utilized in a simple manner.

The following advantages are attained, above all, by the present invention:

Due to the feature that the holding member can be lifted, the skier can step into the binding without any exertion of force. The positive engagement of the sole by means of its extension under a pulling action ensures, on the other hand, that even in case of ice and snow residues in the binding the boot is securely pulled into a locked position and is firmly arrested therein. The act of stepping into the binding can be accomplished without any effort and is enhanced when the binding is locked.

In embodiments where the holding member is guided by a curved track, the curved guide or control track offers the advantage that the curved path can be varied as desired, so that it is possible to obtain a maximally advantageous path of motion for the guide elements, especially rollers. Due to the outside arrangement of the curved guide track (disposed at lateral outside areas of the binding), a reliable optical control is provided to check whether the binding has been duly locked. To securely fix the holding member in the release position or in the in-use sole holding position, the curved guide track or tracks are advantageously constructed to be cam-like with a detent-type upper recess and a detent-type lower recess, engaged by the guide elements in a force-locking fashion under the effect of a spring action. Preferably, a projection extending in the longitudinal direction of the ski over the axis of the roller element or elements is arranged at least above the upper, detent-type recess, so that the stroke of the holding member is safely limited in the upward direction. Especially advantageous is a guidance of the holding member in the forward zone by a curved track extending essentially in a direction vertically to the ski, and in the rearward zone by a guide member exercising its guidance essentially obliquely from the top toward the bottom in the forward direction.

The embodiment with guidance by guide rods offers the advantage, on the other hand, that the holding member is positively guided, independently of the resilient action of the resilient holding means.

In a particularly advantageous embodiment of the invention, the holding member and the supporting or bearing member on the ski side are joined exclusively or practically exclusively by a force-derived (pressure)

connection with the aid of a resilient means. An especially simple assembly is made possible by this feature, particularly if tension springs are employed. By overcoming the spring bias, the holding member can be removed from the supporting or bearing member fixedly attached to the ski; this is accomplished by shifting the holding member by depressing the rearward hook-shaped locking element toward the front so that the forward end of the holding member and/or the guide elements thereof can be lifted out of the guide track. Thereby, the supporting or bearing member affixed to the ski and optionally the mounting screws provided at that location for the last-mentioned member are freely accessible for assembly.

To be able to extend behind the sole extension, the holding member preferably comprises a follower and/or locking member acting in the manner of a hook, which is guided, for example, along a guide member for the locking member on the ski side in a direction obliquely downwardly toward the front when the holding member executes a lowering motion.

A particularly simple and compact structure is furthermore attainable if the locking-guide member simultaneously guides the sole extension in the longitudinal direction of the ski. For this purpose, the guide member is advantageously fashioned as a tang-like portion which is defined in a forward section on its underside, for the guidance of the sole extension, by a longitudinal guide surface in parallel or essentially in parallel to the ski, and which is bent obliquely in the upward direction in a rearward section for the rearward guidance of the holding member; this tang-like portion is advantageously formed by bending the supporting member on the ski side.

Guide members, curved guide tracks, and guide elements such as sliding or roller elements are advantageously arranged in pairs on both sides of the longitudinal plane of symmetry of the ski extending vertically to the latter, so that a uniform and stable guidance of the holding member is thus obtained.

Tension springs are provided, for example, as springs for the force-derived connection of the holding member and the supporting member; these tension springs are arranged on both sides of the longitudinal plane of symmetry of the ski extending vertically to the latter. The springs are preferably connected at their front ends to a common axle of roller elements arranged on both sides of the holding member and, on the other hand, are joined to the guide members for the rearward guidance of the holding member.

To provide an easy operation of the binding, making it possible to actuate the binding without the necessity for the skier to stoop down, a cutout accessible from above is arranged in the holding member. This feature makes it possible to place the tip of a ski pole from above into this cutout and couple the tip with the holding member so that the ski pole is usable as a lever arm, substantially rigidly connected to the holding member, to lift the latter and to release the sole extension. Advantageously, the cutout has a stepped portion to give the tip of the ski pole a contact surface to depress the holding member from the release position into the in-use position. Of course, the binding is also constructed so that it can be locked and/or opened manually instead of with the aid of the ski pole.

Even though coil springs are generally especially advantageous with regard to their function and incorporation into the system, particularly if such springs are fashioned as spiral tension springs, it is contemplated to provide instead leaf springs or other kinds of springs.

The rearward guide means for the holding member, preferably fashioned in the form of tangs which are bent inwardly and upwardly toward the rear, can simultaneously serve for limiting the stroke of the holding member in the release position. The arrangement can also be such that a self-locking action of the boot sole with respect to upwardly directed forces is created by a correspondingly inclined positioning of the guide element.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a lateral view of a ski binding constructed in accordance with a first preferred embodiment of the invention, partially in section along line 1—1 of FIG. 3, shown in the release position with the holding member being lifted;

FIG. 2 is a lateral view similar to FIG. 1, partially in a like sectional view as FIG. 1, but in the closed, locked in-use sole holding position with the holding member being lowered;

FIG. 3 is a top view of FIG. 1, partially in section along line 3—3 of FIG. 1;

FIG. 4 is a cross-sectional view along line 4—4 of FIG. 2; and

DETAILED DESCRIPTION OF THE DRAWINGS

Figure 5:
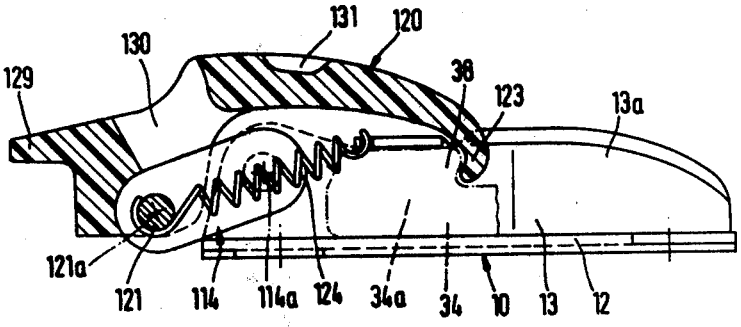
FIG. 5 is a lateral view corresponding to FIG. 1, but showing a second preferred embodiment of the invention.

In the embodiment of FIGS. 1 to 4, the supporting or bearing member 10 located on the ski side and fixedly attached to the ski (not shown) but would extend horizontally under member 10 as shown in FIG. 1 is mounted in a suitable way, for example by means of screws, indicated schematically at 11 in FIG. 1. The supporting or bearing member has a substantially U-shaped cross section with a baseplate 12 constituting the cross member of the "U" and with side walls 13 constituting the legs of the "U" and extending rearwardly, suitably approximately into the toe region of the boot to be held on the ski by the binding. The rearward sections 13*a* of the side walls 13 diverge as seen in a horizontal projection (FIG. 3) rearwardly and become gradually lower as seen in a lateral view (FIGS. 1 and 2, respectively). The supporting or bearing member thus is securely supported and mounted to the ski; in its rearward end portion (not illustrated), the member can additionally be attached to the ski by screws 11 or the like.

The forward edges of the lateral parts 13 are fashioned as curved guide or control tracks 14 with a curved portion 14*a* in the center which is bent and projects cam-like toward the front; an upper curved portion forming a detent-like recess 14*b;* and a lower curved portion forming a lower detent-like recess 14*c*. The upper detent-like recess 14*b* passes over into a projection 15 directed forwardly in the longitudinal extension of the ski, terminating the guide or control track 14 in the upward direction.

Upper, tang-like parts to serve as longitudinal guide means 16 are bent inwardly toward the longitudinal symmetry plane m of the ski and/or the binding, this plane being oriented vertically to the ski; these tang-like parts are provided in a zone of the supporting member 10 which is in the middle as seen in the longitudinal extension of the ski, and they are limited in the downwardly direction by guide surfaces 17 in parallel to the ski. Instead of being disposed parallel to the ski, the lower limiting or guide surfaces can optionally also extend slightly downwardly toward the front in the shape of a wedge with a small wedge angle. The bent-away guide elements 16 carry, along their rear edges, inclined guide parts 18 oriented toward the rear in the upward direction; these guide parts serve, in particular, as the rearward guides for the subsequently described holding member and are limited on their undersides by a guide surface 19 extending obliquely toward the rear in the upward direction in the manner of a wedge.

The holding member 20 to hold the sole of the boot in place is guided at the supporting member 10 affixed to the ski along the curved guide track 14, on the one hand, and at the rearward guide element 18, on the other hand, and is connected to the bearing member 10 on the ski side merely by a force-derived connection.

To provide guidance along the curved guide track 14 in the forward zone, the holding member 20 has an axle or pin 21 continuously extending over the width of the binding to form an articulation connection; this axle 21 is fixedly or rotatably supported in the holding member 20 and carries guide rollers 22 at its ends. In embodiments where the axle 21 is fixedly arranged at the holding member 20, these guide rollers 22 are supported on the axle to be loosely rotatable, while with embodiments having a rotatably mounted axle 21, the guide rollers 22 are firmly joined to this axle. To provide rearward guidance, the holding member 20 is rearwardly provided with a hook-shaped follower and locking element 23 which is oriented from the top obliquely toward the bottom, this inclination being approximately the same as that of the inclined guide parts 18 of the supporting member 10 mounted to the ski. This element 23 engages with its forward, lower end **23*a* underneath the upper end 18*a* of the inclined guide elements 18. On both sides of the longitudinal vertical plane of symmetry m (FIG. 4) of the ski or binding, spiral tension springs 24 are provided under tension, the forward ends 25 of these springs extending around the axle 21 for the guide rollers 22, and the rearward ends of these springs, denoted by 26, being hung into bores 27 of the tang-like guide elements 16. These springs 24 constitute the sole connection between the holding member 20 and the bearing member 10 affixed to the ski according to certain preferred embodiments. However, in the illustrated preferred embodiment, restoring springs are additionally provided which are operatively interconnected between the holding member 20 and the supporting member 10 on the ski side, so that holding member 20 is under a bias in the opening direction (in FIGS. 1 and 2 in the clockwise direction). In the illustrated embodiment, a coil spring 28 is used as the restoring spring and is mounted on the axle 21 of the roller elements 22 in a recess of the holding member 20. At its ends, the spring 28 is hung into (engages against) the spiral tension springs 24 and in its center the spring 28 rests on a wall (vertically extending wall shown in dash lines in FIG. 1) of the holding member 20 so that it exerts a slight opening pressure on the holding member 20**.

The forward end of the holding member 20 is fashioned as a handle 29. Furthermore, the holding member 20 has a cutout 30 extending through the forward end. A projection 32 is arranged in this cutout 30, forming a step 31 and lower front wall **32*a*, and located in opposition to a rearward wall 33 defining the cutout 30**.

The binding of this invention serves for attaching an extension 34 of the sole 35 of a ski boot 36 to a ski so that the boot is firmly placed, tensioned, and locked to the ski. The sole extension 34 has, for this purpose, a forward part **34*a* with a thickened zone in its vertical extension and with an upper guide surface 37, the spacing of which from the baseplate 12 is approximately equal to the spacing of the inwardly projecting longitudinal guide element 16 from the baseplate 12. Furthermore, the sole extension 34 comprises a rearwardly oriented, hook-shaped projection 38 intended for cooperating with the hook-shaped follower and locking member 23 of the holding member 20**.

When used as a cross-country ski binding, the above-described arrangement is the only binding means for securing the boot to the ski. However, this does not exclude the possibility of optionally providing additional binding elements, for example to hook the heel to the ski so that the binding can also be used in certain instances for downhill skiing.

The mode of operation of the binding is as follows:

In FIG. 1, the binding is in the release position. The holding member 20 is lifted, the rollers 22 engage the upper, detent-like recess **14*b* of the curved guide track 14, while the rearward, hook-shaped follower and locking member 23 extends with its forward end 23*a* underneath the rearward upper ends 18*a* of the tang-like inclined guide elements 18. The lateral spiral tension springs 24 pull the holding member 20 in the rearward direction, so that the guide rollers 22 firmly rest in the detent-like recesses 14*b*, while the restoring springs 28** exert a slight upward pressure on the holding member.

In this position of the binding, the ski boot 36, provided with the sole extension 34, can be inserted without any exertion of force from the rear into the binding; the upper guide surface 37 of the sole extension is guided along the lower guide surface 17 of the longitudinal guide element 16 in the longitudinal extension of the ski in the forward direction.

To tighten the binding, the holding member 20 is pressed downwardly. This can be done manually or also by means of the tip of the ski pole, pressed approximately in the direction of arrow f against the step 31 in the cutout 30. On account of the downward pressure exerted on the holding member 20, the guide rollers 22 roll along the curved guide track 14 and pass, under the tension of the tension springs 24, over the cam-like projecting, curved portion **14*a* to a point at the lower detent recess 14*c*. During this process, the rearward hook-shaped follower and locking member 23 of the holding member 20 is simultaneously guided along the lower, inclined guide surfaces 19 of the guide elements 16, 18; the end 23*a* of this locking member 23 extends under the rearward projection 38 of the sole extension and pulls, during its further movement, the sole extension 34 and/or the boot 36 positively in the forward direction as seen in the longitudinal direction of the ski, until the sole extension 34, as illustrated in FIG. 2, is firmly in engagement with the binding and is locked against displacement toward the rear by the hook-shaped part 23** of the holding member.

Accumulations of snow or ice in the binding are thereby pushed forwardly and/or toward the outside by the sole extension. By observing the curved guide track 14, one can determine whether the holding member is in the proper sole holding position. This position is shown in FIG. 2.

To release the binding, the holding member 20 is lifted upwardly by seizing the handle 29, the rollers 22 returning along the curved guide track 14 into the position shown in FIG. 1 where they are in the detent-like recess 14*b*. The hook-shaped part 23 slides again upwardly along the inclined guide surface 19 so that the sole extension 34 is released. Instead of a manual operation, the lifting step can also be effected by means of the ski pole by placing the latter, as schematically indicated in FIG. 2, with its tip into the recess 30. By causing the ski pole to bear on the lower front wall of the projection 32 of B and on the opposed wall 33, at A, the skier can thus lift the holding member 20 from the lower, locked position according to FIG. 2 into the release position according to FIG. 1, using the ski pole as a lower arm.

The binding is secured against unintended release when exposed to upwardly oriented forces occurring during skiing by the feature that these forces act approximately or almost vertically on the inclined guide surface 19, thereby creating a self-locking action between parts 23 and 18.

In the embodiment of FIG. 5, identical or practically identical parts as those in the preceding embodiment carry the same reference numerals.

The holding member 120 with the projection 129 serving as a handle is, in this embodiment, guided with respect to the baseplate by means of a guide rod 114 or by a pair of such guide rods which are hingedly attached, for example, on both sides outside of the side walls 13 of the baseplate 12 fixed to the ski. The guide rod or rods 114 are pivotably mounted in the side walls 13 by means of hinge pins about transverse ski axles 114*a* and an articulation connection with the holding member 120 is formed by means of hinge pins or axles 121 about the transverse ski axis 121*a*. As compared to the preceding embodiment, the transverse ski axis 114*a* corresponds approximately to the center of curvature of the curved guide track 14 and/or of the track portion 14*a*, and the transverse ski axle 121*a* corresponds to the axis of the guide rollers 22. Spiral tension springs 124 are tensioned between the hinge pin 121 and the side walls 13 of the baseplate 12 and secure the holding member 120 in its open position, so that it cannot pass on its own into the illustrated closed position.

The holding member 120 furthermore has a hook-shaped follower and locking part 123 which extends behind the rearwardly oriented projection 38 of the thickened portion 34*a* of the forward boot sole extension, but which releases the sole extension when the holding member is lifted, after the guide rod or rods 114 have been pivoted upwardly past their dead center position with respect to the springs 124. A recess 130 serves for opening (lifting) the holding member 120, and a depression 131 serves for closing same by means of the ski pole in an appropriate manner, as described hereinabove for the embodiment of FIGS. 1 to 4.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Ski binding apparatus for cross-country skiing and the like comprising:

a ski boot with a boot sole and a boot sole extension formed integrally with the boot sole, said sole extension having an entrainable portion located forwardly of the ski boot, a boot sole holding member engageable with the boot sole extension to hold the same in a predetermined in-use position on a ski, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of said boot sole extension and pulls the boot sole extension in said longitudinal direction to its in-use position on the ski, further comprising spring means having one portion attached to a binding part that is fixed to the ski, said spring means being configured to resiliently force said holding member toward each of said release and holding positions.

2. Ski binding apparatus according to claim 1, wherein the guide means includes at least one curved guide track for guiding the holding member with respect to the surface of the ski obliquely toward the front and approximately in a translatory fashion, wherein said at least one curved guide track is configured to maintain said holding member in said lower sole holding position, wherein the sole extension includes a hook-shaped projection, and wherein the holding member includes a hook-shaped follower extendible underneath the counter projection at the sole extension to exert a pulling force oriented toward the front after movement of the holding member along the at least one curved guide track against the detent resistance of the spring means.

3. Ski binding apparatus according to claim 2, wherein the holding member is guided in the zone of its front end as well as in the zone of its rear end by said guide means during its movement between the upper release position and the lower sole holding position.

4. Ski binding apparatus according to claim 3, wherein the curved guide tracks are arranged at parts fixedly mounted to the ski and wherein the holding member is guided, by means of guide elements arranged at the holding member, along the curved guide tracks.

5. Ski binding apparatus according to claim 4, wherein at least the guide elements of the forward end of the holding member are fashioned at least partially as rollers.

6. Ski binding apparatus according to claim 4, wherein the hook-shaped follower serves simultaneously as a rearward guide element of said holding member.

7. Ski binding apparatus according to claim 6, wherein at least the guide elements of the forward end of the holding member are fashioned at least partially as rollers.

8. Ski binding apparatus according to claim 4, wherein a rear guide member is provided which guidingly engages a guide element carried by said holding member for the rearward, inclined guidance of the holding member, said rear guide member being configured to simultaneously engage and guide the sole extension in the longitudinal direction of the ski.

9. Ski binding apparatus according to claim 8, wherein the rear guide member, preferably fashioned to be a flat component, is limited in a forward portion on its underside, to guide the sole extension by a ski-parallel, or substantially ski-parallel, guide surface and is obliquely upwardly bent in a rearward portion to guide the holding member in the rearward direction.

10. Ski binding apparatus according to claim 4, wherein the guide means including the curved guide tracks, for the holding member, as well as guide elements carried by the holding member, are arranged in pairs on respective opposite sides of the longitudinal vertically extending plane of symmetry m of the ski.

11. Ski binding apparatus according to claim 9, wherein the guide means including the curved guide tracks for the holding member, as well as guide elements carried by the holding member, are arranged in pairs on respective opposite sides of the longitudinal vertically extending plane of symmetry m of the ski.

12. Ski binding apparatus according to claim 2, wherein a forward one of the curved guide tracks comprises a curve section projecting cam-like toward the front, a detent-like upper recess, and a detent-like lower recess to receive one of a sliding element and a roller element, said one of said sliding and roller elements engaging these recesses under spring force.

13. Ski binding apparatus according to claim 12, wherein the curved guide tracks have, at least above the upper detent-like recess, a projection extending in the longitudinal direction of the ski, said projection serving as a manually engageable handle for accommodating movement of said holding member between its release and sole holding positions.

14. Ski binding apparatus according to claim 13, wherein said projection is disposed above an axle which supports said one of said roller element and sliding element.

15. Ski binding apparatus according to claim 1, wherein said guide means includes:

front curved guide track means for guidingly accommodating a front guide element means carried by said holding member, and rear guide track means for guidingly accommodating rear guide element means of said holding member.

16. Ski binding apparatus according to claim 15, wherein said longitudinal direction is a forward direction with said holding member engageable with a front boot sole extension.

17. Ski binding apparatus according to claim 15, wherein the rear guide element means and the front curved guide track means are formed by a supporting member, common to both of them and having an approximately U-shaped cross section, the side walls of this supporting member forming the legs of the "U", constituting at their front edges, the curved guide track means for the associated front guide element means of the holding member and, at inwardly bent top edge portions forming the rear guide track means.

18. Ski binding apparatus according to claim 17, wherein said inwardly bent top edge portions of said supporting member also form a longitudinal guide surface for a boot sole extension held by said holding member.

19. Ski binding apparatus according to claim 16, wherein the holding member is held in engagement by means of its front guide element means, merely by a force-derived connection under spring force of its front guide element means with the front curved guide track means.

20. Ski binding apparatus according to claim 17, wherein the holding member is held in engagement by means of its front guide element means, merely by a force-derived connection under spring force of its front guide element means with the front curved guide track means.

21. Ski binding apparatus according to claim 16, wherein the front guide element means of the holding member is continuously pressed against the front curved guide track means with the aid of tension spring means forming said spring means.

22. Ski binding apparatus according to claim 17, wherein the front guide element means of the holding member is continuously pressed against the front curved guide track means with the aid of tension spring means forming said spring means.

23. Ski binding apparatus according to claim 21, wherein said tension spring means includes one tension spring arranged on each of both sides of the central vertical plane of symmetry m of said holding member, wherein the tension springs are connected to a common support axle of the front guide element means and to the rear guide track means.

24. Ski binding apparatus according to claim 17, wherein said tension spring means includes one spring arranged on each of both sides of the central vertical plane of symmetry m of said holding member, wherein the tension springs are connected to a common support axle of the front guide element means and to the rear guide track means.

25. Ski binding apparatus according to claim 23, wherein said front guide element means are rollers disposed on the common support axle at respective opposite ends thereof.

26. Ski binding apparatus according to claim 16, wherein the rear guide track means includes a rearward, oblique guide track portion facing the ski which is so inclined that the direction of the forces occurring during skiing and oriented upwardly against the sole extension extends approximately at right angles to the oblique guide track portion surface and/or within such an angle of inclination with respect to the oblique guide track portion surface that there is created a self-locking action between a hook-shaped locking member of the holding member and the rear guide track means affixed to the ski.

27. Ski binding apparatus according to claim 26, wherein the rear guide element means and the front curved guide track means are formed by a supporting member, common to both of them and having an approximately U-shaped cross section, the side walls of this supporting member forming the legs of the "U", constituting at their front edges, the curved guide track means for the associated front guide element means of the holding member and, at inwardly bent top edge portions forming the rear guide track means.

28. Ski binding apparatus according to claim 26, wherein the holding member is held in engagement by means of its front guide element means, merely by a force-derived connection under spring force of its front guide element means with the front curved guide track means.

29. Ski binding apparatus according to claim 16, wherein a cutout is provided in the holding member which is accessible from above, this cutout including respective vertically spaced front and rear bearing wall portions engageable with a tip of a ski pole inserted from above such that the ski pole is coupled with the holding member and forms a lever arm by its essentially rigid connection with the holding member at the bearing wall portions, whereby the holding member can be lifted from its sole holding to its release position by the ski pole and the boot sole extension can be released.

30. Ski binding apparatus according to claim 1, wherein said spring means includes a tension spring attached at one end to said fixed binding part and at the opposite end to said holding member, and wherein said guide means are configured such that maximum elongation of said tension spring occurs when said holding member is intermediate its release and holding positions.

31. Ski binding apparatus according to claim 30, wherein an axle is carried by said holding member at the forward end thereof, and wherein said tension spring is attached to said axle, said axle being disposed vertically below the attachment point of said spring at the fixed binding part when said holding member is in its holding position.

32. Ski binding apparatus for cross-country skiing and the like comprising:

a ski boot with a boot sole and a boot sole extension formed integrally with the boot sole, said sole extension having an entrainable portion located forwardly of the ski boot, a boot sole holding member engageable with the boot sole extension to hold the same in a predetermined in-use position on a ski, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of said boot sole extension and pulls the boot sole extension in said longitudinal direction to its in-use position on the ski, wherein a cutout is provided in the holding member which is accessible from above, this cutout including respective vertically spaced front and rear bearing wall portions engageable with a tip of a ski pole inserted from above such that the ski pole is coupled with the holding member and forms a lever arm by its essentially rigid connection with the holding member at the bearing wall portions, whereby the holding member can be lifted from its sole holding to its release position by the ski pole and the boot sole extension can be released.

33. Ski binding apparatus according to claim 32, wherein the cutout has a step to accommodate depression of the holding member into the sole holding position.

34. Ski binding apparatus according to claim 32, wherein said ski boot is held in an in-use skiing position by engagement of said holding member at said sole extension with said boot being pivotal about a transverse axis in front of the toe region of the ski boot.

35. Ski binding apparatus for cross-country skiing and the like comprising:

a ski boot with a boot sole and a boot sole extension formed integrally with the boot sole, said sole extension having an entrainable portion located forwardly of the ski boot, a boot sole holding member engageable with the boot sole extension to hold the same in a predetermined in-use position on a ski, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of said boot sole extension and pulls the boot sole extension in said longitudinal direction to its in-use position on the ski, wherein said boot sole extension is a front boot sole extension, wherein said longitudinal direction is a forward direction with said holding member engageable with the front boot sole extension, and wherein a cutout is provided in the holding member which is accessible from above, this cutout including respective vertically spaced front and rear bearing wall portions engageable with a tip of a ski pole inserted from above such that the ski pole is coupled with the holding member and forms a lever arm by its essentially rigid connection with the holding member at the bearing wall portions, whereby the holding member can be lifted from its sole holding to its release position by the ski pole and the boot sole extension can be released.

36. Ski binding apparatus according to claim 35, wherein said ski boot is held in an in-use skiing position by engagement of said holding member at said sole extension with said boot being pivotal about a transverse axis in front of the toe region of the ski boot.

37. Ski binding apparatus for cross-country skiing and the like comprising:

a ski boot with a boot sole and a boot sole extension formed integrally with the boot sole, said sole extension having an entrainable portion located forwardly of the ski boot, a boot sole holding member engageable with the boot sole extension to hold the same in a predetermined in-use position on a ski, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of said boot sole extension and pulls the boot sole extension in said longitudinal direction to its in-use position on the ski, wherein the guide means includes guide rod means pivotally attached directly to the holding member and to a part of the ski binding that is fixed to the ski, the pivotal attachment of the guide rod means at the fixed part being disposed to assure forward movement of the holding member as the holding member is moved downward from a first side of a deadcenter position toward its holding position, and resilient spring means for biasing said holding member toward said release position from said deadcenter position when said guide rod means are on an opposite side of said deadcenter position from said first side and for biasing said holding member toward the holding position when the guide rod means is on the first side.

38. Ski binding apparatus for cross-country skiing and the like comprising:

a ski boot with a boot sole and a boot sole extension formed integrally with the boot sole, said sole extension having an entrainable portion located forwardly of the ski boot, a boot sole holding member engageable with the boot sole extension to hold the same in a predetermined in-use position on a ski, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of said boot sole extension and pulls the boot sole extension in said longitudinal direction to its in-use position on the ski, wherein the guide means includes guide rod means pivotally attached directly to the holding member and to a part of the ski binding that is fixed to the ski, the pivotal attachment of the guide rod means at the fixed part being disposed to assure forward movement of the holding member as the holding member is moved downward from its release position through a deadcenter position toward its holding position, further comprising a tension spring attached to the fixed part of the binding and to the holding member, said tension spring being configured to resiliently force said holding member toward each of its release and holding positions.

39. Ski binding apparatus according to claim 38, wherein the attachment point of the tension spring and the holding member moves downwardly to a position below the attachment point of tension spring at the fixed part of the binding during movement of the holding member from its release to its holding position.

40. Ski binding apparatus for detachably attaching a cross-country ski boot of the type having a sole extension to a ski, comprising:

a boot sole holding member engageable with the boot sole extension to hold the same in a predetermined in-use position on a ski, said boot sole extension having an entrainable portion located forwardly of the ski boot, and holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of the boot sole extension and pulls the boot sole extension in said longitudinal direction to its in-use position on the ski, wherein a cutout is provided in the holding member which is accessible from above, this cutout including respective vertically spaced front and rear bearing wall portions engageable with a tip of a ski pole inserted from above such that the ski pole is coupled with the holding member and forms a lever arm by its essentially rigid connection with the holding member at the bearing wall portions, whereby the holding member can be lifted from its sole holding to its release position by the ski pole and the boot sole extension can be released.

41. Ski binding apparatus according to claim 40, wherein the guide means includes guide rod means pivotally attached directly to the holding member and to a part of the ski binding that is fixed to the ski, the pivotal attachment of the guide rod means at the fixed part being disposed to assure forward movement of the holding member as the holding member is moved downward from its release position through a dead center position toward its holding position.

42. Ski binding apparatus according to claim 41, further comprising a tension spring attached to the fixed part of the binding and to the holding member, said tension spring being configured to resiliently force said holding member toward each of its release and holding positions.

43. Ski binding apparatus for detachable attaching a cross-country ski boot of the type having a sole extension with an entrainable portion to a ski, comprising:

a boot sole holding member engageable with the boot sole extension to hold the same in a predetermined in-use position on a ski, holding member guide means for guiding movement of said holding member between a lifted release position and a lowered sole holding position, said guide means including means for assuring movement of said holding member in the longitudinal direction of the ski when said holding member is moved from its release position to its sole holding position so that said holding member positively entrains the entrainable portion of the boot sole extension and pulls the boot sole extension in said longitudinal direction to its in-use position on the ski, and spring means having one portion attached to and movable with said holding member and another portion attached to a binding part that is fixed to the ski, said spring means being configured to resiliently force said holding member toward each of said release and holding positions.

44. Ski binding apparatus according to claim 43, wherein said spring means includes a tension spring attached at one end to said fixed binding part and at the opposite end to said holding member, and wherein said guide means are configured such that maximum elongation of said tension spring occurs when said holding member is intermediate its release and holding positions.

45. Ski binding apparatus according to claim 44, wherein an axle is carried by said holding member at the forward end thereof, and wherein said tension spring is attached to said axle, said axle being disposed vertically below the attachment point of said spring at the fixed binding part when said holding member is in its holding position.

46. Ski binding apparatus according to claim 43, wherein the guide means includes guide rod means pivotally attached directly to the holding member and to said fixed part of the ski binding, the pivotal attachment of the guide rod means at the fixed part being disposed to assure forward movement of the holding member as the holding member is moved downward from its release position through a dead center position toward its holding position.

47. Ski binding apparatus according to claim 46, further comprising a tension spring attached to the fixed part of the binding and to the holding member, said tension spring being configured to resiliently force said holding member toward each of its release and holding positions.

48. Ski binding apparatus according to claim 47, wherein the attachment point of the tension spring and the holding member moves downwardly to a position below the attachment point of tension spring at the fixed part of the binding during movement of the holding member from its release to its holding position.

* * * * *